US010707583B2

(12) United States Patent
Kuo et al.

(10) Patent No.: US 10,707,583 B2
(45) Date of Patent: Jul. 7, 2020

(54) WIRELESS COMMUNICATION MODULE

(71) Applicant: Arcadyan Technology Corporation, Hsinchu (TW)

(72) Inventors: Shin-Lung Kuo, Kaohsiung (TW); Shih-Chieh Cheng, Tainan (TW)

(73) Assignee: ARCADYAN TECHNOLOGY CORPORATION (TW)

( * ) Notice: Subject to any disclaimer, the term of this patent is extended or adjusted under 35 U.S.C. 154(b) by 127 days.

(21) Appl. No.: 16/000,691

(22) Filed: Jun. 5, 2018

(65) Prior Publication Data

US 2018/0375212 A1 Dec. 27, 2018

(30) Foreign Application Priority Data

Jun. 23, 2017 (TW) ..... 106120993 A

(51) Int. Cl.

| | |
|---|---|
| ***H01Q 13/18*** | (2006.01) |
| ***H01Q 1/24*** | (2006.01) |
| ***H01Q 1/52*** | (2006.01) |
| ***H01Q 21/28*** | (2006.01) |
| ***H01Q 13/10*** | (2006.01) |

(Continued)

(52) U.S. Cl.

CPC ..... *H01Q 13/18* (2013.01); *H01Q 1/243* (2013.01); *H01Q 1/521* (2013.01); *H01Q 3/40* (2013.01); *H01Q 9/04* (2013.01); *H01Q 13/10* (2013.01); *H01Q 21/28* (2013.01)

(58) Field of Classification Search

CPC ..... H01Q 1/243; H01Q 1/52; H01Q 9/0407; H01Q 1/38; H01Q 13/10; H01Q 13/18

See application file for complete search history.

(56) References Cited

U.S. PATENT DOCUMENTS 6,034,646 A * 3/2000 Heddebaut ..... B61L 3/227 343/771

6,801,165 B2 * 10/2004 Fang ..... H01Q 9/0414 343/700 MS (Continued)

OTHER PUBLICATIONS

European Search Report, Application No. 18178799.5, dated Oct. 18, 2018, pp. 1-12.

(Continued)

*Primary Examiner* — Dameon E Levi
*Assistant Examiner* — Hasan Z Islam
(74) *Attorney, Agent, or Firm* — Innovation Counsel LLP

(57) ABSTRACT

A wireless communication module including a substrate, a first antenna, a second antenna and a resonator group is provided. The first antenna and the second antenna are disposed on the substrate. The resonator group is disposed between the first antenna and the second antenna and separated from the first antenna and the second antenna. The resonator group includes a first resonator and a second resonator. The first resonator includes a first resonant cavity, a first extension slot, a first conductive portion and a second conductive portion. The first extension slot extends towards a lateral surface of the substrate from the first resonant cavity. The first conductive portion and the second conductive portion are located within the first resonant cavity and separated from each other. The second resonator includes a second resonant cavity and a second extension slot extending towards the lateral surface from the second resonant cavity.

4 Claims, 4 Drawing Sheets

(51) Int. Cl.
*H01Q 3/40* (2006.01)
*H01Q 9/04* (2006.01)

(56) References Cited

U.S. PATENT DOCUMENTS

| | | | | |
|---|---|---|---|---|
| 2010/0079217 | A1 | 4/2010 | Morton et al. | |
| 2012/0274522 | A1 | 11/2012 | Ayatollahi | |
| 2017/0085011 | A1* | 3/2017 | Kim | H01Q 1/3233 |

OTHER PUBLICATIONS

Kim et al., "The High Isolation Dual-Band Inverted F Antenna Diversity System with the Small N-Section Resonators on the Ground Plane," Asia-Pacific Microwave Conference, IEICE, Dec. 1, 2006, pp. 195-198.

* cited by examiner

WIRELESS COMMUNICATION MODULE

This application claims the benefit of Taiwan application Serial No. 106120993, filed Jun. 23, 2017, the subject matter of which is incorporated herein by reference.

BACKGROUND OF THE INVENTION

Field of the Invention

The invention relates in general to a wireless communication module, and more particularly to a wireless communication module having a resonator.

Description of the Related Art

Conventional wireless communication module has multiple antennas disposed very close to each other in order to meet the requirements of slimness, thinness, and lightweight. Under such design, interference between antennas becomes inevitable. Therefore, it has become a prominent task for the industries to provide a wireless communication module capable of resolving signal interference between the antennas.

SUMMARY OF THE INVENTION

The invention is directed to a wireless communication module capable of resolving the above problems.

According to one embodiment of the present invention, a wireless communication module is provided. The wireless communication module includes a substrate, a first antenna, a second antenna and a resonator group. The substrate has a lateral surface. The first antenna and the second antenna are adjacent to the lateral surface of the substrate. A connection direction between the first antenna and the second antenna is parallel to the lateral surface. The resonator group is disposed between the first antenna and the second antenna and separated from the first antenna and the second antenna along a direction parallel to the lateral surface. The resonator group includes a first resonator and a second resonator. The first resonator is adjacent to the lateral surface of the substrate and includes a first resonant cavity, a first extension slot, a first conductive portion and a second conductive portion. The first extension slot extends towards the lateral surface of the substrate from the first resonant cavity and forms an opening on the lateral surface. The first conductive portion and the second conductive portion are located within the first resonant cavity and separated from each other. The second resonator is separated from the first resonator along a direction perpendicular to the lateral surface and includes a second resonant cavity and a second extension slot. The second extension slot extends towards the lateral surface of the substrate from the second resonant cavity and is separated from the first resonant cavity of the first resonator. The first resonator is disposed between the lateral surface of the substrate and the second resonator.

According to another embodiment of the present invention, a wireless communication module is provided. The wireless communication module includes a substrate, a first antenna, a second antenna, a first resonator group and a second resonator group. The substrate has a lateral surface. The first antenna and the second antenna are adjacent to the lateral surface of the substrate. A connection direction between the first antenna and the second antenna is parallel to the lateral surface. The first resonator group and the second resonator group both are disposed between the first antenna and the second antenna and separated from the first antenna and the second antenna along a direction parallel to the lateral surface. The first resonator group is adjacent to the first antenna and includes a first resonator and a second resonator. The first resonator is adjacent to the lateral surface of the substrate and includes a first resonant cavity, a first extension slot, a first conductive portion and a second conductive portion. The first extension slot extends towards the lateral surface of the substrate from the first resonant cavity and forms an opening on the lateral surface, and the first conductive portion and the second conductive portion are located within the first resonant cavity and separated from each other. The second resonator is separated from the first resonator along a direction perpendicular to the lateral surface and includes a second resonant cavity and a second extension slot. The second extension slot extends towards the lateral surface of the substrate from the second resonant cavity and is separated from the first resonant cavity of the first resonator. The first resonator is disposed between the lateral surface and the second resonator. The second resonator group is disposed between the first resonator group and the second antenna and includes a third resonator and the fourth resonator. The third resonator is adjacent to the lateral surface of the substrate and includes a third resonant cavity, a third extension slot, a third conductive portion and a fourth conductive portion. The third extension slot extends towards the lateral surface of the substrate from the third resonant cavity and forms another opening on the lateral surface. The third conductive portion and the fourth conductive portion are located within the third resonant cavity and separated from each other. The fourth resonator is separated from the third resonator along a direction perpendicular to the lateral surface and includes a fourth resonant cavity and a fourth extension slot. The fourth extension slot extends towards the lateral surface of the substrate from the fourth resonant cavity and separated from the third resonant cavity of the third resonator. The third resonator is disposed between the lateral surface and the fourth resonator.

According to an alternate embodiment of the present invention, a wireless communication module is provided. The wireless communication module includes a substrate, a first antenna, a second antenna, a first resonator group and a second resonator group. The substrate has a lateral surface. The first antenna and the second antenna are adjacent to the lateral surface of the substrate. A connection direction between the first antenna and the second antenna is parallel to the lateral surface. The first resonator group and the second resonator group are disposed between the first antenna and the second antenna and separated from the first antenna and the second antenna along a direction perpendicular to the lateral surface. The first resonator group is adjacent to the first antenna and includes a first resonator and a second resonator. The resonator is adjacent to the lateral surface and includes a first resonant cavity, a first extension slot, a first conductive portion and a second conductive portion. The first extension slot extends towards the lateral surface of the substrate from the first resonant cavity and forms an opening on the lateral surface, and the first conductive portion and the second conductive portion are located within the first resonant cavity and separated from each other. The second resonator is separated from the first resonator along a direction perpendicular to the lateral surface and comprising a second resonant cavity and a second extension slot. The second extension slot extends towards the lateral surface of the substrate from the second resonant cavity and is separated from the first resonant cavity of the first resonator, wherein the first resonator is disposed between the lateral surface and the second resonator. The second resonator group is disposed between the first antenna and the second antenna and includes a third resonator and a fourth resonator. The third resonator is adjacent to the first resonator group and comprising a third resonant cavity, a third extension slot, a third conductive portion and a fourth conductive portion, wherein the third extension slot extends towards the lateral surface of the substrate from the third resonant cavity and is separated from the second resonant cavity of the second resonator, and the third conductive portion and the fourth conductive portion are located within the third resonant cavity and separated from each other. The fourth resonator is separated from the third resonator along a direction perpendicular to the lateral surface and comprising a fourth resonant cavity and a fourth extension slot, wherein the fourth extension slot extends towards the lateral surface of the substrate from the fourth resonant cavity and is separated from the third resonant cavity of the third resonator, wherein the third resonator is disposed between the lateral surface and the second resonator group.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
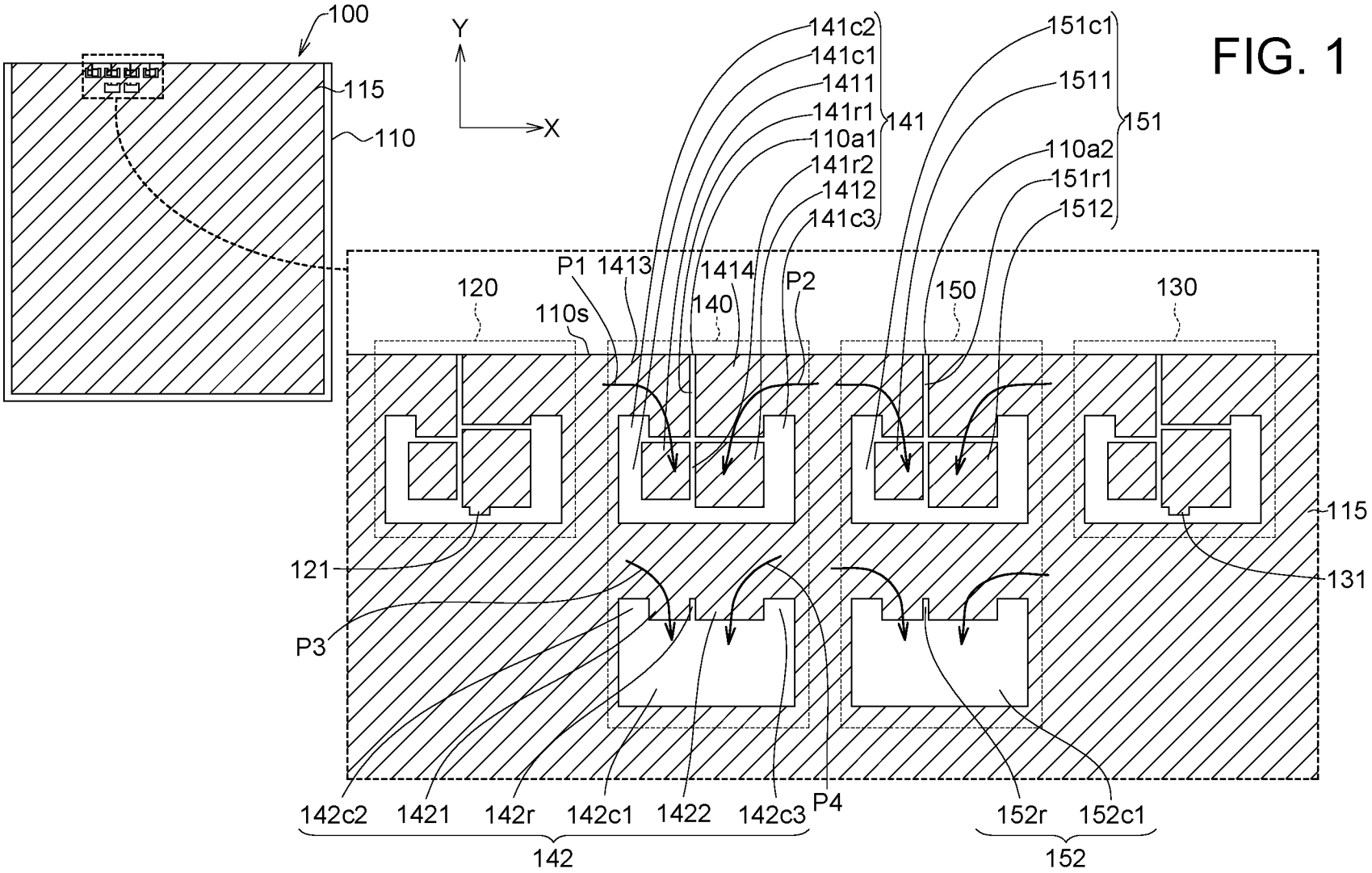
FIG. 1 is a top view of a wireless communication module according to an embodiment of the present invention.

Referring to FIG. 1, a top view of a wireless communication module 100 according to an embodiment of the present invention is shown. The wireless communication module 100, such as a circuit board, can be disposed on an electronic device for receiving/transmitting wireless signals, and can be realized by such as a mobile phone, a smart watch, a PC tablet, a wireless transceiver, or other suitable products. The wireless communication module 100 includes a substrate 110, a first antenna 120, a second antenna 130 and at least one resonator group. The at least one resonator group includes a first resonator group 140 and a second resonator group 150. The substrate 110 has a ground layer 115 formed thereon, wherein the ground layer 115, the first antenna 120, the second antenna 130, the first resonator group 140 and the second resonator group 150 can be located on the same layer. In terms of the manufacturing process, the ground layer 115, the first antenna 120, the second antenna 130, the first resonator group 140 and the second resonator group 150 can be formed in the same manufacturing process. The first antenna 120, the second antenna 130, the first resonator group 140 and the second resonator group 150 can be disposed on the same side of the substrate 110. Besides, the first antenna 120 and the second antenna 130 can be realized by any types of antennas, such as monopole antennas, helical antennas, micro-strip antennas, inverted F-type antennas, or split-ring resonators, and are not subjected to particular restrictions in the present invention.

As indicated in FIG. 1, the first antenna 120 and the second antenna 130 respectively include feeding points 121 and 131. The current can be fed to the first antenna 120 and the second antenna 130 respectively through the feeding points 121 and 131 (current paths P1 and P2 illustrated in bold lines) to be distributed on the ground layer 115. The impedances of the first antenna 120 and the second antenna 130 match the impedance of the driving source of the current, and therefore a wireless signal is generated. The first resonator group 140 and the second resonator group 150 are located between the first antenna 120 and the second antenna 130 and separated from the first antenna 120 and the second antenna 130 along a direction parallel to a lateral surface 110*s*. The second resonator group 150 is located between the first resonator group 140 and the second antenna 130. The resonator group (such as the first resonator group 140 and the second resonator group 150) is electrically isolated from the first antenna 120 and the second antenna 130 to isolate the wireless signal between the first antenna 120 and the second antenna 130, such that the interference of wireless signals between two antennas can be avoided or reduced. In an embodiment, the first resonator group 140 and/or the second resonator group 150 has the function of split-ring resonator (SRR).

In the present embodiment, the quantity of resonator groups is exemplified by two (that is, the first resonator group 140 and the second resonator group 150). However, the quantity of resonator groups can also be exemplified by one or more than two. When the quantity of resonator groups is exemplified by more than two, multiple resonator groups can be arranged as an n×m matrix, wherein n and m are positive integers equivalent to or larger than 1, and can have the same or different values. As indicated in FIG. 1, multiple resonator groups can be arranged in a direction parallel to the connection direction between the first antenna 120 and the second antenna 130 such as along the X-axis. Or, multiple resonator groups can be arranged in a direction perpendicular to the connection direction between the first antenna 120 and the second antenna 130 such as along the Y-axis.

The impedances of the first resonator group 140 and the second resonator group 150 match the impedance of the driving source of the current. Thus, after the first resonator group 140 and the second resonator group 150 attract the current of the ground layer 115, the current can be excited by the resonator group 140 to generate a wireless signal to enhance the signal strength of the wireless communication module 100. The first resonator group 140 and the second resonator group 150 can be separated from any electronic elements of the wireless communication module 100 or can be disposed independently to avoid or reduce the current distributed on the ground layer 115 being attracted by the electronic elements, such that the signal strength of the first resonator group 140 and the second resonator group 150 can be further enhanced. The said electronic elements can be realized by any types of active elements (such as active chips) and/or passive elements (such as resistors, inductors and/or capacitors).

Each resonator group includes at least two resonators separated from each other. Let the first resonator group 140 of FIG. 1 be taken for example. The first resonator group 140 includes a first resonator 141 and a second resonator 142 separated from each other along a direction perpendicular to the lateral surface 110*s*. The structure of the first resonator 141 and/or the second resonator 142 can be identical or similar to that of the first antenna 120 or the second antenna 130 or different from that of the first antenna 120 or the second antenna 130. The geometric structures of the resonators are not subjected to particular restrictions in the embodiments of the present invention, and any structures would do as long as the said structures allow the structures allow the first resonator 141 and/or the second resonator 142 to be separated from each other.

As indicated in FIG. 1, the first resonator 141 is adjacent to the lateral surface 110*s* and includes a first resonant cavity 141*c*1, a first extension slot 141*r*1, a first conductive portion 1411 and a second conductive portion 1412. The first extension slot 141*r*1 extends towards the lateral surface 110*s* of the substrate 110 from the first resonant cavity 141*c*1 and forms (or exposes) a first opening 110*a*1 on the lateral surface 110*s*. The first conductive portion 1411 and the second conductive portion 1412 are located within the first resonant cavity 141*c*1 and separated from each other. The sizes and geometric structures of the first conductive portion 1411 and the second conductive portion 1412 can match the operating band of the wireless communication module 100, such that the current distributed on the ground layer 115 is excited by the first resonator 141 to generate a wireless signal whose frequency is within the operating band.

The first resonator 141 can attract the wireless signals of the first antenna 120 and the second antenna 130 to avoid the wireless signals interfering with each other. Detailed descriptions are disclosed below.

As indicated in FIG. 1, the first resonator 141 is closer to the lateral surface 110*s* of the substrate 110 than the second resonator 142. Since the first extension slot 141*r*1 of the first resonator 141 extends to the lateral surface 110*s* and exposes the first opening 110*a*1, the first extension slot 141*r*1 can divide the ground layer 115 disposed on the left side and the right side of the first extension slot 141*r*1 into conducting layers 1413 and 1414 respectively providing two independent or separated current paths P1 and P2. Thus, the current distributed on the ground layer 115 can respectively be guided to the first resonant cavity 141*c*1 through the paths formed by the conducting layers 1413 and 1414. Then, the current is excited to generate a wireless signal, such that the signal strength of the wireless communication module 100 can be enhanced.

As indicated in FIG. 1, a groove 141*r*2, formed between the first conductive portion 1411 and the second conductive portion 1412, completely separates the first conductive portion 1411 from the second conductive portion 1412. Similarly, the first conductive portion 1411 and the second conductive portion 1412 can respectively provide two independent or separated current paths P1 and P2. Thus, the current distributed on the ground layer 115 can respectively be guided to the first resonant cavity 141*c*1 through the paths formed by the first conductive portion 1411 and the second conductive portion 1412. Then, the current is excited to generate a wireless signal, such that the signal strength of the wireless communication module 100 can be enhanced. In the present embodiment, the groove 141*r*2 of the first extension slot 141*r*1 can be substantially collinear with each other, non-collinear but parallel with each other, or neither collinear nor parallel with each other.

As indicated in FIG. 1, the first resonant cavity 141*c*1 is a quadrilateral, such as a rectangle. The first resonator 141 further includes a first extension cavity 141*c*2 and a second extension cavity 141*c*3 respectively located on two opposite sides of the first extension slot 141*r*1 and separated from the first extension slot 141*r*1. The first extension cavity 141*c*2 and the second extension cavity 141*c*3 both extend towards the lateral surface 110*s* from the same side of the first resonant cavity 141*c*1. The first extension cavity 141*c*2 and the second extension cavity 141*c*3 can define the current paths P1 and P2 with more obvious boundaries, such that the current distributed on the ground layer 115 can be more easily attracted to the first resonant cavity 141*c*1.

As indicated in FIG. 1, the second resonator 142 includes a second resonant cavity 142*c*1 and a second extension slot 142*r*. The second extension slot 142*r* extends towards the lateral surface 110*s* from the second resonant cavity 142*c*1 but is separated from the first resonant cavity 141*c*1 before extending to the first resonant cavity 141*c*1 of the first resonator 141. The second extension slot 142*r* divides the ground layer 115 into conducting layers 1421 and 1422 to respectively provide two independent or separated current paths P3 and P4. Thus, the current distributed on the ground layer 115 can respectively be guided to the second resonant cavity 142*c*1 by the conducting layers 1421 and 1422. Then, the current is excited to generate a wireless signal, such that the signal strength of the wireless communication module 100 can be enhanced.

The second resonator 142 increases the distribution area of the first resonator group 140 and therefore attracts more current distributed on the ground layer 115. In another embodiment, the first resonator group 140 includes more second resonators 142 or more structures similar to the second resonator 142. The resonators of the first resonator group 140 can be arranged as a straight line, an n×m matrix or any arrangement. The arrangement and/or quantity of the resonators of the first resonator group 140 are not subjected to particular restriction in the embodiments of the present invention, and any arrangement and/or quantity would do as long as the said arrange and/or quantity allow the resonators to attract the current distributed on the ground layer 115.

The second resonant cavity 142*c*1 is a quadrilateral, such as a rectangle. The second resonator 142 further includes a third extension cavity 142*c*2 and a fourth extension cavity 142*c*3 respectively located on two opposite sides of the second extension slot 142*r* and separated from the second extension slot 142*r*. The third extension cavity 142*c*2 and the fourth extension cavity 142*c*3 both extend towards the lateral surface 110*s* from the same side of the second resonant cavity 142*c*1, but do not extend to the first resonator 141. The third extension cavity 142*c*2 and the fourth extension cavity 142*c*3 can define the current paths current paths P3 and P4 with more obvious boundaries, such that the current distributed on the ground layer 115 can be more easily attracted to the second resonant cavity 142*c*1.

As indicated in FIG. 1, the second resonator group 150 includes a third resonator 151 and a fourth resonator 152 separated from each other along a direction perpendicular to the lateral surface 110*s*. The structure of the third resonator 151 and/or the fourth resonator 152 can be identical or similar to that of the first antenna 120 or the second antenna 130 or different from that of the first antenna 120 or the second antenna 130. The geometric structures of the resonators are not subjected to particular restrictions in the embodiments of the present invention, and any structures would do as long as the said structures allow the third resonator 151 and/or the fourth resonator 152 to be separated from each other.

The third resonator 151 is adjacent to the lateral surface 110*s* and includes a third resonant cavity 151*c*1, a third extension slot 151*r*1, a third conductive portion 1511 and a fourth conductive portion 1512. The third extension slot 151r1 extends towards the lateral surface 110s from the third resonant cavity 151c1 and forms a second opening 110a2 on the lateral surface 110s. The third conductive portion 1511 and the fourth conductive portion 1512 are located within the third resonant cavity 151c1 and separated from each other.

The fourth resonator 152 is separated from the third resonator 151 along a direction perpendicular to the lateral surface 110s. The fourth resonator 152 includes a fourth resonant cavity 152c1 and a fourth extension slot 152r. The fourth extension slot 152r extends towards the lateral surface 110s from the fourth resonant cavity 152c1 and is separated from the third resonant cavity 151c1 of the third resonator 151. The third resonator 151 is disposed between the lateral surface 110s and the fourth resonator 152.

Other structures of the third resonator 151 are similar to corresponding structures of the first resonator 141, and/or other structures of the fourth resonator 152 are similar to corresponding structures of the second resonator 142, and the similarities are not repeated here. In an embodiment, the third resonator 151 and the first resonator 141 have the same shape, and so do the fourth resonator 152 and the second resonator 142 have the same shape, but the embodiments of the present invention are not limited thereto.

Figure 2:
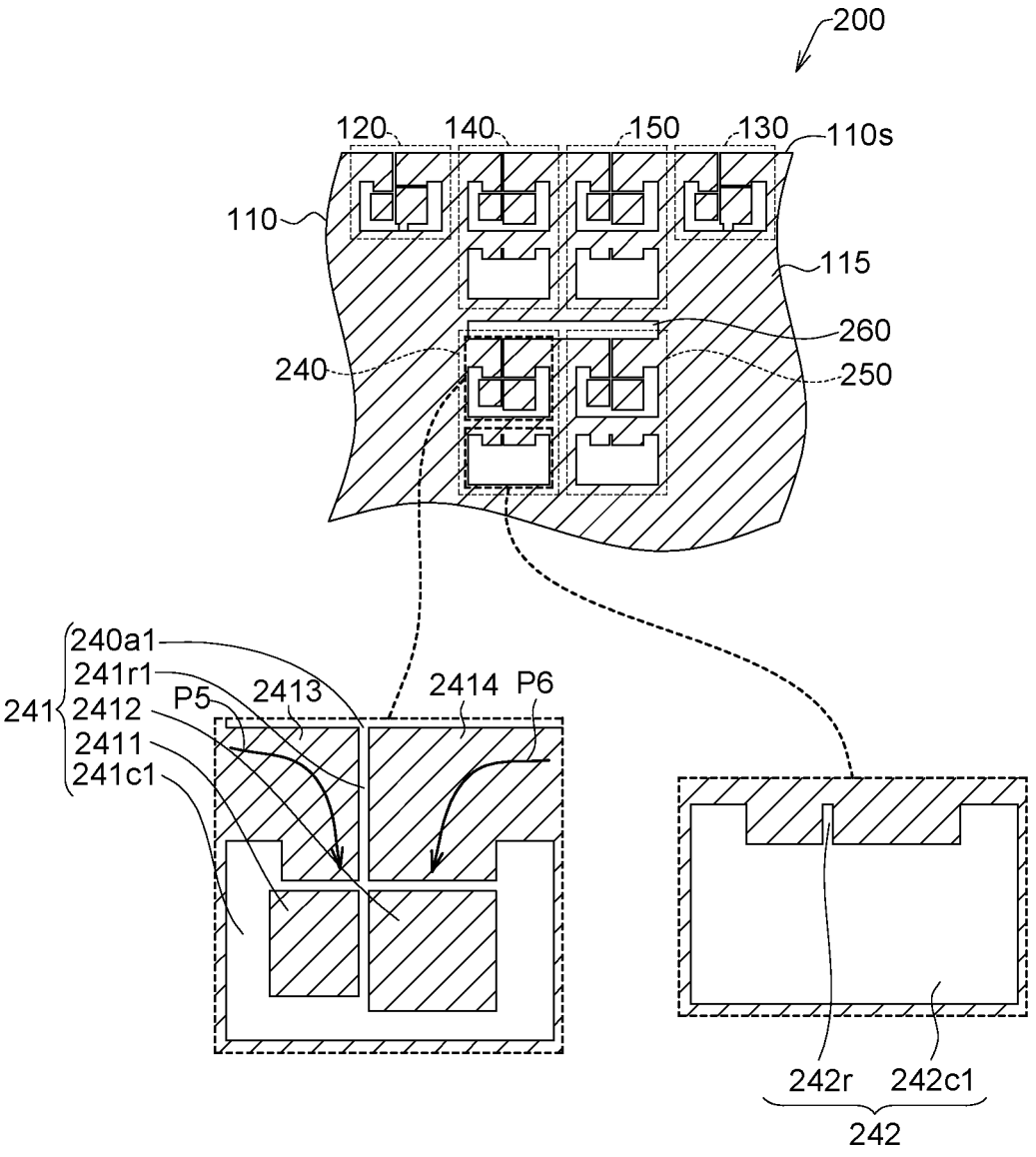
FIG. 2 is a top view of a wireless communication module according to another embodiment of the present invention.

Referring to FIG. 2, a top view of a wireless communication module 200 according to an embodiment of the present invention is shown. The wireless communication module 200, such as a circuit board, can be disposed on an electronic device for receiving/transmitting wireless signals. The wireless communication module 200 includes a substrate 110, a first antenna 120, a second antenna 130 and at least one resonator group. The at least one resonator group includes such as the first resonator group 140 and the second resonator groups 150, 240 and 250.

Unlike the above embodiments, the first resonator group 140 and the second resonator groups 150, 240 and 250 together are arranged as a 2×2 matrix in the present embodiment. The first resonator group 140 is separated from the second resonator group 240 along a direction perpendicular to the lateral surface 110s. The second resonator group 150 is also separated from the second resonator group 250 along a direction perpendicular to the lateral surface 110s. The second resonator groups 240 and 250 are arranged along a direction parallel to the lateral surface 110s.

Let the second resonator group 240 be taken for example. The second resonator group 240 includes a third resonator 241 and a fourth resonator 242 separated from each other along a direction perpendicular to the lateral surface 110s. The structure of the third resonator 241 and/or the fourth resonator 242 can be identical or similar or to that of the first antenna 120 or the second antenna 130 or different from that of the first antenna 120 or the second antenna 130. The geometric structures of the resonators are not subjected to particular restrictions in the embodiments of the present invention, and any structures would do as long as the said structures allow the third resonator 241 and/or the fourth resonator 242 to be separated from each other.

The third resonator 241 is adjacent to the first resonator group 140 and includes a third resonant cavity 241c1, a third extension slot 241r1, a third conductive portion 2411 and a fourth conductive portion 2412. The third extension slot 241r1 extends towards the first resonator group 140 from the third resonant cavity 241c1 and forms a third opening 240a1 on the expansion slot 260. The third conductive portion 2411 and the fourth conductive portion 2412 are located within the third resonant cavity 241c1 and separated from each other. The expansion slot 260 are located between two resonator groups, such as between the first resonator group 140 and the second resonator group 240, and are located between the second resonator group 150 and the second resonator group 250.

The expansion slot 260 can extend along a direction parallel to the lateral surface 110s to be connected to the second resonator groups 240 and 250 disposed underneath the expansion slot 260 but is not adjacent to the lateral surface 110s. The third extension slot 241r1 of the second resonator group 240 extends to the expansion slot 260 to divide the ground layer 115, disposed between the expansion slot 260 and the third resonant cavity 241c1, into two separated conducting layers 2413 and 2414. The conducting layers 2413 and 2414 respectively provide current paths P5 and P6 through which the current is guided to the third resonant cavity 241c1.

The fourth resonator 242 is separated from the third resonator 241 along a direction perpendicular to the lateral surface 110s and includes a fourth resonant cavity 242c1 and a fourth extension slot 242r. The fourth extension slot 242r extends towards the third resonator 241 from the fourth resonant cavity 242c1 and is separated from the third resonant cavity 241c1 of the third resonator 241. The third resonator 241 is disposed between the expansion slot 260 and the fourth resonator 242.

Other structures of the third resonator 241 are similar to corresponding structures of the first resonator 141, and/or other structures of the fourth resonator 242 are similar to corresponding structures of the second resonator 142, and the similarities are not repeated here. In an embodiment, the third resonator 241 and the first resonator 141 have the same shape, and so do the fourth resonator 242 and the second resonator 142 have the same shape, but the embodiments of the present invention are not limited thereto. Besides, the structure of the second resonator group 250 is similar to that of the second resonator group 240, and the relationship between the second resonator group 250 and the expansion slot 260 is similar to that between the second resonator group 240 and the expansion slot 260, and the similarities are not repeated here.

Figure 3A:
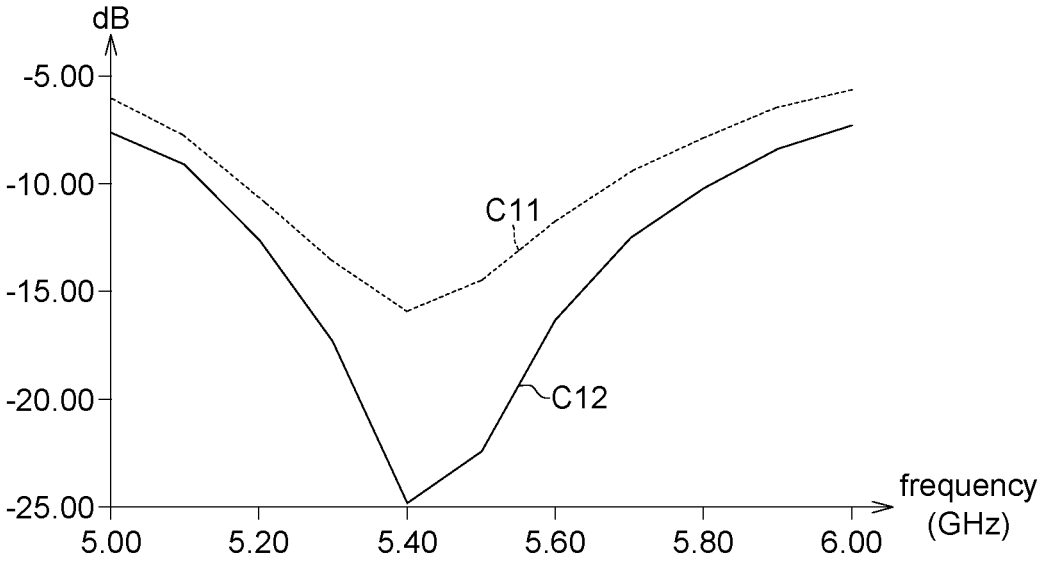
FIGS. 3A and 3B are return loss characteristic diagram of a conventional wireless communication module and the wireless communication module of FIG. 1.
Figure 3B:
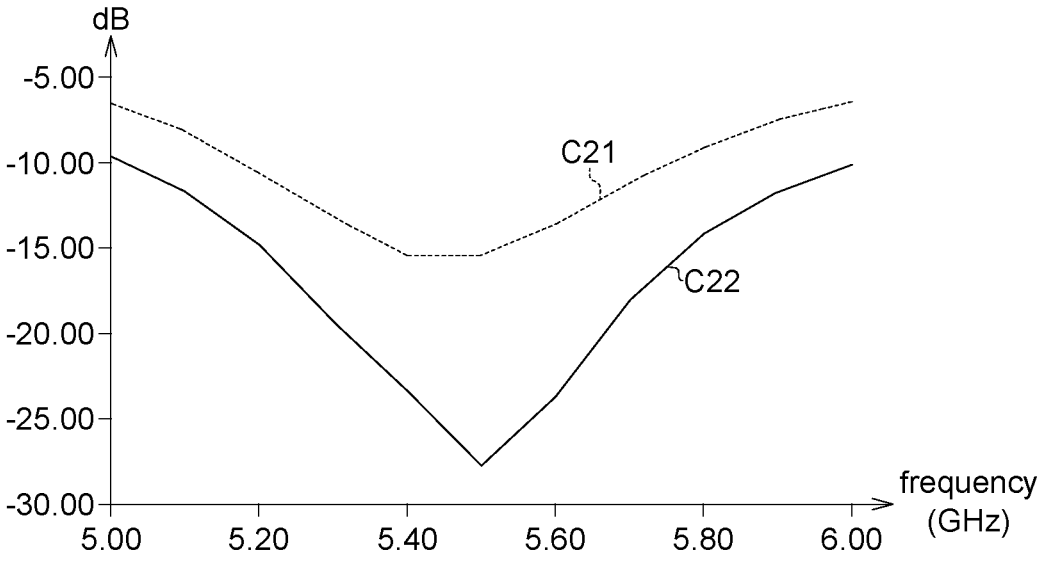

Referring to FIGS. 3A and 3B, return loss characteristic diagrams of a conventional wireless communication module and the wireless communication module 100 of FIG. 1 are shown. In FIG. 3A, curve C11 denotes a return loss characteristic curve of the first antenna of a conventional wireless communication module not having a resonator group 140; curve C12 denotes a return loss characteristic curve of the first antenna 120 of FIG. 1. In FIG. 3B, curve C21 denotes a return loss characteristic curve of the second antenna of a conventional wireless communication module not having a resonator group 140; curve C22 denotes a return loss characteristic curve of the second antenna 130 of FIG. 1. A comparison between curves C11, C12, C21 and C22 shows that the return loss of the first antenna 120 and the return loss of the second antenna 130 of the wireless communication module 100 having the resonator group 140 both drop significantly within a frequency band of 5.15 GHz~5.85 GHz (the lower the return loss, the larger the signal strength).

Figure 4:
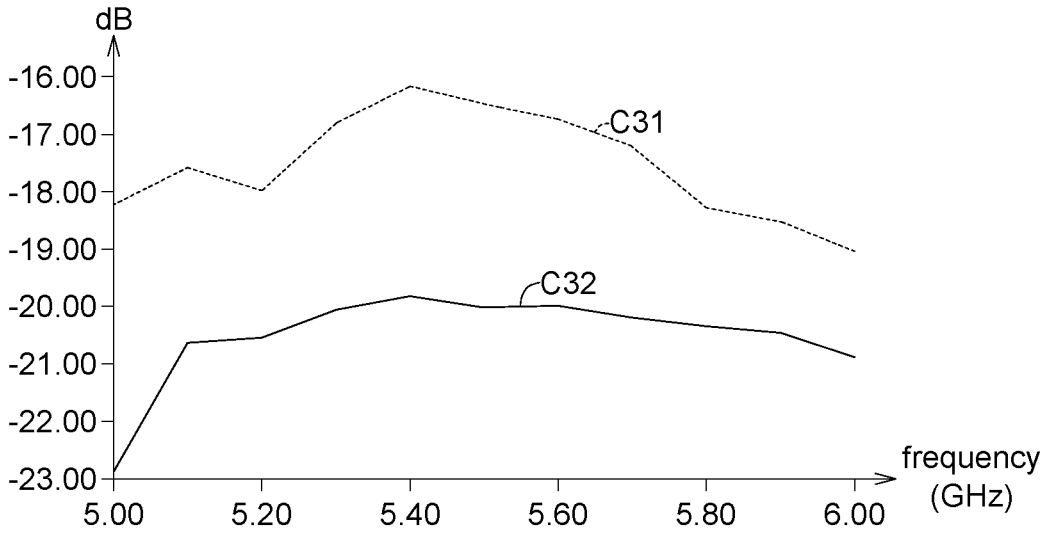
FIG. 4 is an isolation diagram of a conventional wireless communication module and the wireless communication module of FIG. 1.

Referring to FIG. 4, an isolation diagram of a conventional wireless communication module and the wireless communication module 100 of FIG. 1 is shown. In FIG. 4, curve C31 denotes an isolation characteristic curve of a conventional wireless communication module not having a resonator group 140; curve C32 denotes an isolation characteristic curve of the wireless communication module 100 of FIG. 1. A comparison between curves C31 and C32 shows that the isolation of the wireless communication module 100 having a resonator group 140 drops significantly when the wireless signal is within a frequency band of 5.15 GHz~5.85 GHz (the lower the isolation, the better the performance of isolation).

As indicated in Table 1, group A1 denotes a radiation efficiency of the first antenna 120 of the wireless communication module 100 of FIG. 1; group A2 denotes a radiation efficiency of the second antenna 130 of the wireless communication module 100 of FIG. 1; group B1 denotes a radiation efficiency of the first antenna of a conventional wireless communication module; group B2 denotes a radiation efficiency of the second antenna of a conventional wireless communication module. Table 1 shows that when the wireless signal is within a frequency band of 5.1 GHz~5.9 GHz, the radiation efficiency of the wireless communication module 100 of the embodiments of the present invention is larger than 71, and is larger than that of a conventional wireless communication module.

TABLE 1

| | Frequency | | | | | | | | |
|---|---|---|---|---|---|---|---|---|---|
| Group | 5.1 | 5.2 | 5.3 | 5.4 | 5.5 | 5.6 | 5.7 | 5.8 | 5.9 |
| A1 | 72.2 | 74.2 | 78.3 | 84.9 | 86.2 | 85.1 | 82.2 | 75.9 | 71.1 |
| A2 | 78 | 77.4 | 79.3 | 84.3 | 83.6 | 86 | 86.1 | 82.7 | 81.3 |
| B1 | 64.4 | 69 | 73.3 | 78.5 | 79 | 76.9 | 72.9 | 65.9 | 60.6 |
| B2 | 68 | 70.2 | 73.4 | 78.1 | 78.1 | 78.6 | 76.8 | 71.2 | 67.7 |

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A wireless communication module, comprising:

a substrate, having a lateral surface;

a first antenna, adjacent to the lateral surface of the substrate;

a second antenna, adjacent to the lateral surface of the substrate, wherein a connection direction between the first antenna and the second antenna is parallel to the lateral surface;

a first resonator group and a second resonator group, disposed between the first antenna and the second antenna and separated from the first antenna and the second antenna along a direction perpendicular to the lateral surface, wherein the first resonator group is adjacent to the first antenna and comprises:

a first resonator, adjacent to the lateral surface and comprising a first resonant cavity, a first extension slot, a first conductive portion and a second conductive portion, wherein the first extension slot extends towards the lateral surface of the substrate from the first resonant cavity and forms an opening on the lateral surface, and the first conductive portion and the second conductive portion are located within the first resonant cavity and separated from each other; and a second resonator, separated from the first resonator along a direction perpendicular to the lateral surface and comprising a second resonant cavity and a second extension slot, wherein the second extension slot extends towards the lateral surface of the substrate from the second resonant cavity and is separated from the first resonant cavity of the first resonator, wherein the first resonator is disposed between the lateral surface and the second resonator;

wherein the second resonator group is disposed between the first resonator group and the second antenna and comprises:

a third resonator, adjacent to the first resonator group and comprising a third resonant cavity, a third extension slot, a third conductive portion and a fourth conductive portion, wherein the third extension slot extends towards the lateral surface of the substrate from the third resonant cavity and is separated from the second resonant cavity of the second resonator, and the third conductive portion and the fourth conductive portion are located within the third resonant cavity and separated from each other;

a fourth resonator, separated from the third resonator along a direction perpendicular to the lateral surface and comprising a fourth resonant cavity and a fourth extension slot, wherein the fourth extension slot extends towards the lateral surface of the substrate from the fourth resonant cavity and is separated from the third resonant cavity of the third resonator, wherein the third resonator is disposed between the lateral surface and the second resonator group.

2. The wireless communication module according to claim 1, wherein the first resonator and the third resonator have the same shape, and the second resonator and the fourth resonator have the same shape.

3. The wireless communication module according to claim 1, further comprising:

an expansion slot, located between the first resonator group and the second resonator group along a direction perpendicular to the lateral surface and separated from the first resonator group;

wherein the third extension slot of the second resonator group extends to the expansion slot to form another opening.

4. The wireless communication module according to claim 3, wherein the expansion slot extends along a direction parallel to the lateral surface.

* * * * *